US010361075B2

(12) United States Patent
Chapon et al.

(10) Patent No.: US 10,361,075 B2
(45) Date of Patent: Jul. 23, 2019

(54) PROCESS AND APPARATUS FOR MEASURING AN ORGANIC SOLID SAMPLE BY GLOW DISCHARGE SPECTROMETRY

(71) Applicant: HORIBA JOBIN YVON SAS, Longjumeau (FR)

(72) Inventors: Patrick Chapon, Villebon sur Yvette (FR); Agnes Tempez, Massy (FR); Sebastien Legendre, Guyancourt (FR)

(73) Assignee: HORIBA JOBIN YVON SAS, Longjumeau (FR)

( * ) Notice: Subject to any disclaimer, the term of this patent is extended or adjusted under 35 U.S.C. 154(b) by 0 days.

(21) Appl. No.: 15/301,218

(22) PCT Filed: Mar. 27, 2015

(86) PCT No.: PCT/FR2015/050809
§ 371 (c)(1),
(2) Date: Sep. 30, 2016

(87) PCT Pub. No.: WO2015/150677
PCT Pub. Date: Oct. 8, 2015

(65) Prior Publication Data

US 2017/0018417 A1 Jan. 19, 2017

(30) Foreign Application Priority Data

Mar. 31, 2014 (FR) ..... 14 52826

(51) Int. Cl.
*H01J 49/10* (2006.01)
*H01J 49/00* (2006.01)
(Continued)

(52) U.S. Cl.
CPC ..... *H01J 49/105* (2013.01); *H01J 49/0031* (2013.01); *H01J 49/24* (2013.01); *H01J 49/40* (2013.01)

(58) Field of Classification Search
CPC ..... H01J 49/105; H01J 49/0031; H01J 49/40
See application file for complete search history.

(56) References Cited

U.S. PATENT DOCUMENTS 5,036,195 A * 7/1991 Batey ..... H01J 49/0422 250/281
2008/0078928 A1 4/2008 Wang et al.

FOREIGN PATENT DOCUMENTS

EP 2 434 275 A1 3/2012
FR 2 965 355 A1 3/2012

OTHER PUBLICATIONS

Pereiro, Rosario, et al: "Present and future of glow discharge—Time of flight mass spectrometry in analytical chemistry", Spectrochimica Acta. Part B: Atomic Spectroscopy, New York, NY, US, US, vol. 66, No. 6, May 27, 2011 (May 27, 2011), pp. 399-412, XP028238305, ISSN: 0584-8547, [retrieved on Jun. 12, 2011], DOI: 10.1016/J.SAB.2011.05.008.

(Continued)

*Primary Examiner* — Eliza W Osenbaugh-Stewart
(74) *Attorney, Agent, or Firm* — Young & Thompson

(57) ABSTRACT

A system and a process for measuring, by glow discharge spectrometry, the elemental and/or molecular chemical composition of an organic solid sample (10). The sample (10) is positioned so as to seal a glow discharge plasma reactor (2), a gaseous mixture including at least one inert gas and gaseous oxygen is injected into the reactor (2), the concentration of gaseous oxygen being between 0.1% and 15% by weight of the gaseous mixture, an electric discharge of radiofrequency type is applied to the electrodes of the plasma reactor (2) in order to generate a glow discharge plasma, and the solid sample (10) is exposed to the plasma so as to etch an erosion crater in the solid sample (10); at least one signal representative of an ionized species of (Continued)

negative charge is selected and measured using a mass spectrometer (4).

20 Claims, 3 Drawing Sheets

(51) Int. Cl.
*H01J 49/24* (2006.01)
*H01J 49/40* (2006.01)

(56) References Cited

OTHER PUBLICATIONS

Canulescu, Stela, et al: "Detection of negative ions in glow discharge mass spectrometry for analysis of solid specimens", Analytical and Bioanalytical Chemistry, Springer, Berlin, DE, vol. 396, No. 8, Dec. 24, 2009 (Dec. 24, 2009), pp. 2871-2879, XP019798705, ISSN: 1618-2650.
Bentz, B. L., et al: "Negative ions of sputtered cathode species in a glow discharge", International Journal of Mass Spectrometry and Ion Physics, vol. 37, No. 2, Feb. 1, 1981 (Feb. 1, 1981), pp. 167-176, XP055162807, ISSN: 0020-7381, DOI: 10.1016/0020-7381(81)80005-8.
International Search Report, dated Jul. 9, 2015, from corresponding PCT Application.

* cited by examiner

Fig.3
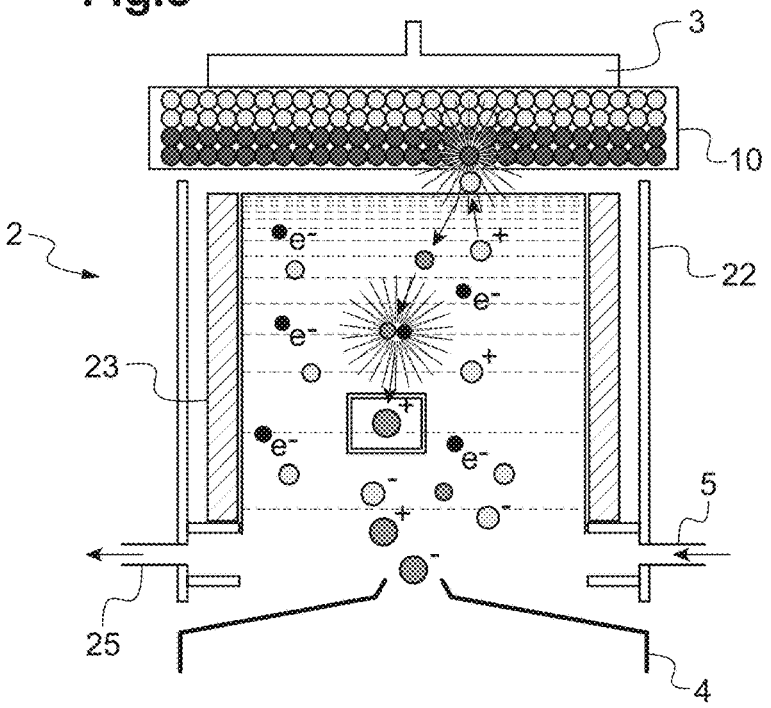
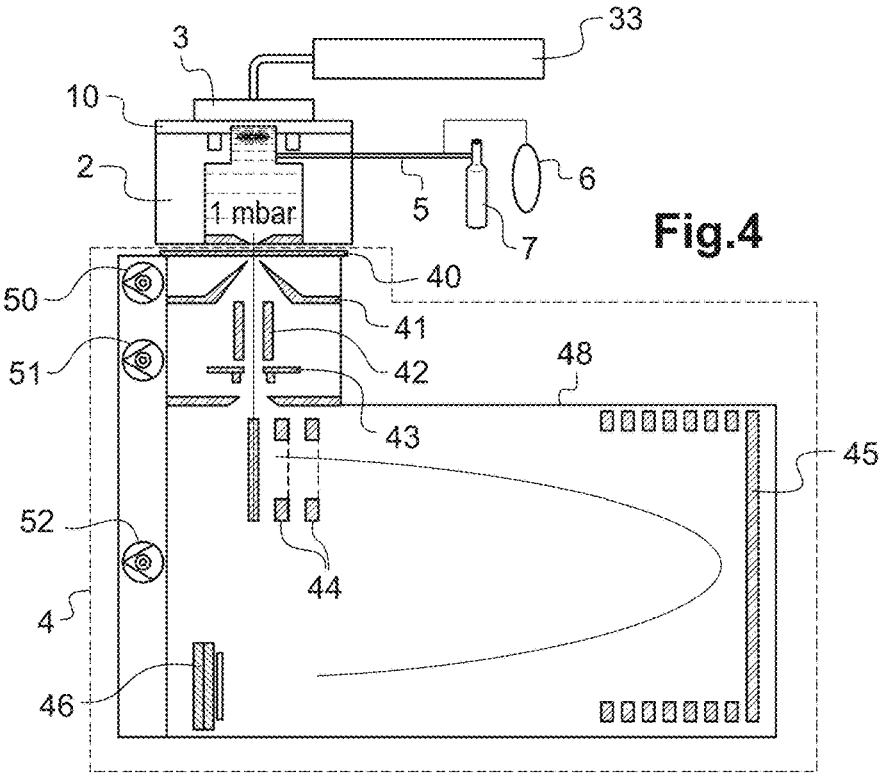
Fig.4

PROCESS AND APPARATUS FOR MEASURING AN ORGANIC SOLID SAMPLE BY GLOW DISCHARGE SPECTROMETRY

BACKGROUND OF THE INVENTION

Field of the Invention

The present invention relates to a method and a device for measuring by glow discharge spectrometry a solid sample comprising at least one layer of organic or polymer material.

The glow discharge spectrometry (GDS) is a technique of elementary and/or molecular analysis of solid materials that makes it possible in particular to measure the elementary chemical composition of materials or stacks of thin (from a few nanometers to a few hundreds of nm) or thick (up to several tens or hundreds of microns) layers, wherein this analysis can be depth-resolved.

A glow discharge spectrometer generally comprises a plasma reactor, also called discharge lamp, comprising a vacuum chamber. A sample to be analysed is generally arranged so as to close the vacuum chamber. The sample to be analysed is exposed to an etching plasma that performs a surface ablation. Moreover, the plasma ensures, via different physicochemical mechanisms, the excitation and ionization of the eroded species. The plasma reactor forms a source of ionized and/or excited species. The follow-up of the species present in the plasma hence allows measuring the elementary chemical, molecular composition and possibly the speciation of the chemical form of the elements detected. To that end, the vacuum chamber of the plasma source is connected via an opening to a mass spectrometer for the detection of ionized species and/or, respectively, via an optical window to an optical spectrometer for the analysis of excited species.

Now, an extended exposure of the sample to the ablation plasma produces a crater of erosion in depth. An analysis of the plasma as a function of the duration of ablation may allow determining the composition of the sample, depth-resolved, when the erosion is produced with a uniform etching of the sample, i.e. when the ablation crater has a flat bottom and flanks perpendicular to the bottom. The glow discharge spectrometry may hence allow obtaining the profile of the chemical composition of thick or thin-layer materials as a function of the depth of erosion (from a few tens of nanometers to a few tens of microns thick) with a nanometric resolution in the most favourable cases.

Initially limited to the conducting materials and layers due to the use of direct-current (DC) sources, the glow discharge spectrometry now allows analysing semiconducting materials and insulating materials thanks to the use of radiofrequency (RF) sources.

The glow discharge spectrometers give good results in particular for the samples on conducting or semiconducting (for ex. silicon) support, which allow a good coupling of the electric field in the plasma and a rapid erosion (typically of the order of one micron per minute). On the other hand, in the case of a sample on insulating substrate or comprising organic or polymer layers, the erosion is generally far slower (the sputtering rate is at least 100 times lower than for conducting or semiconducting layers) and the plasma may produce a warming of the sample that may lead to a damaging of the latter. Moreover, the flanks of the erosion crater are in this case generally not perpendicular with respect to the crater bottom, which harms the depth-resolution.

To form a plasma, a plasma reactor of the Grimm source type is generally used. The bearing gas injected in the reactor to form the plasma is generally a pure rare gas. Argon is the rare gas the most used in glow discharge mass spectrometry for several reasons: the argon ions are efficient ablation agents and the levels of energy in an argon plasma are sufficient to ionize the majority of the elements of the periodic table. Moreover, argon has a simple spectrum that does not disturb the spectrometric measurements.

Other rare gases than argon may also be used, as neon or krypton, for the purpose of increasing the sputtering rate and/or the ionization yield. Different gaseous mixtures have also been experimented for various glow discharge spectrometry applications (with optical detection or mass detection).

Description of the Related Art

Firstly, a mixture of argon with another rare gas has been tested. The publication of Hartenstein et al. (J. Anal. At. Spectrom., 1999, 14, pp. 1039-1048) assesses the effects of using a mixture of argon and helium in an RF glow discharge source for analysing by glow discharge optical spectrometry solid materials such as metals or glasses. The mixture of argon and helium allows increasing the intensity of certain atomic emission rays and it is mentioned that the mixture of helium and argon increases the ionization yield in the analysis of glasses. However, according to the Hartenstein et al. publication, the adjunction of helium to argon does not allow reaching the maximum etching rate obtained with a pure argon plasma, whether it is for a sample of the glass or of the metal type.

Secondly, several groups have tried a mixture of argon and a molecular gas. However, the phenomena of collision and radiation occurring in a plasma in the presence of a gas mixture and the interactions with the surface of the sample are extremely complex and are not yet fully understood.

The publication of A. Martin et al. ("Modifying argon glow discharges by hydrogen addition: effects on analytical characteristics of optical emission and mass spectrometry detection modes", Anal. Bioanal. Chem, 2007, 388:1573-1582) reviews different studies about the effects of the addition of hydrogen to argon in glow discharge spectrometry. The addition of a low quantity of hydrogen (1-10%) in an argon plasma generally produces an increase of the ionization yields, which is important in mass spectrometry. However, the hydrogenated species induce a multiplication of rays in the mass spectrum, which complicate the latter and may significantly modify the quantitative analysis of the ray intensity. Moreover, hydrogen negatively affects the etching rate for metal samples.

Oxygen may be present in a glow discharge spectrometer, either as an impurity in the bearing rare gas, or as a byproduct of the etching of materials containing oxygen, or also as a component of a gaseous mixture forming the bearing gas. The presence of oxygen in a glow discharge spectrometer is generally considered as an impurity generating spurious rays, which are superimposed to the searched rays of the sample, as for example the OH rays.

Certain authors have evaluated the effects of the voluntary addition of gaseous oxygen to a rare gas to modify the conditions of the glow discharge.

The publication of A. Bogaerts ("Effects of oxygen addition to argon glow discharges: A hybrid Monte Carlo-fluid modeling investigation") relates to a theoretical modeling of the effects of adding a molecular gas of hydrogen $H_2$, nitrogen $N_2$ or oxygen $O_2$ to argon in a glow discharge spectrometry device with a direct-current source (dc-GDS). According to this publication, the addition of 0.05 to 5% of oxygen produces a reduction of the density in metastable excited species of the Arm* type and a reduction of the density of eroded atoms, even for low concentrations of oxygen.

Furthermore, the reduction of the etching rate in the presence of gaseous oxygen is attributed to the formation of a layer of oxide on the cathode of the glow discharge spectrometer, which is also accompanied with a reduction of the intensity of the emission rays.

On the other hand, the article of Fernandez et al. ("Investigations of the effects of hydrogen, nitrogen or oxygen on the in-depth profile analysis by radiofrequency argon glow discharge-optical emission spectrometry", J. Anal. AT. Spectrom. 2003, 18, 151-156) has analysed the effects of a mixture of argon and oxygen (0.5-10% v/v) in radiofrequency glow discharge spectrometry and also observes a severe reduction of the etching rate for samples of both the metal or the glass type, which limits the GDS analysis to layers of a few nanometers thick.

The analysis of organic samples by glow discharge spectrometry poses different problems. In a conventional GDS device, for example based on an optical detection and using a pure argon plasma, the sputtering rate is of several microns/minute for samples of the metal type whereas it is generally lower than 20 nm/minute for organic samples or layers. This low sputtering rate makes it very difficult to analyse thick organic samples or films. On the other hand, the bad etching uniformity obtained on organic samples does not allow an in depth resolution to analyse surfaces or thin layers buried under a layer of thick organic material (from several microns to several tens of microns thick). Finally, the numerous chemical species coming from the erosion of the sample (for example molecular emission rays of CH, OH, NH or CO type) are liable to interfere with the bearing gas(es) of the plasma and hence to reduce the signals detected and to disturb the quantitative analysis by glow discharge spectrometry.

The patent document FR2965355 describes a method of measurement by glow discharge spectrometry adapted for an organic or polymer solid sample. In this method, a glow discharge of the radiofrequency type is applied to a gaseous mixture comprising at least one rare gas and gaseous oxygen, the concentration in gaseous oxygen being comprised between 1 and 10 mass % of the gaseous mixture and at least one signal representative of an excited species of said plasma is measured by means of an optical spectrometer and/or, respectively, at least one signal representative of an ionized species is measured by means of a mass spectrometer. The method described in this patent document FR2965355 allows increasing the etching rate in particular for the organic or polymer materials, while ensuring an excellent etching uniformity, and hence allows obtaining a flat-bottom etching crater. In many applications, the measurements by optical emission spectrometry using this method offer an improvement of the signal-to-noise ratio, compared with the prior-art methods of glow discharge spectrometry for organic or polymer solid samples.

Moreover, the document "Rosario Pereiro et al., Present and future of glow discharge Time of flight mass spectrometry in analytical chemistry, Spectrochemica Acta Part B: Atomic spectroscopy, vol. 66, no. 6, pages 399-412" is a review paper that discloses different recent instrumental developments of devices coupling a glow discharge to a time-of-flight mass spectrometer (GD-TOFMS) as well as various applications to the elementary or molecular analysis of materials or thin layers.

BRIEF SUMMARY OF THE INVENTION

One of the objects of the invention is to propose a method and a device for analysing organic or polymer solid samples (or containing polymer or organic layers) by glow discharge spectrometry permitting to etch a sample having a thickness ranging from a few nanometers to about one hundred of microns, with an excellent etching uniformity, while increasing the signal-to-noise ratio of the signals detected.

Another object of the invention is to improve the quality of the measurements by glow discharge spectrometry to allow a more accurate analysis of the elementary and/or molecular chemical composition of a solid sample comprising at least one layer of polymer or organic material.

The present invention has for object to remedy the drawbacks of the prior-art techniques and more particularly relates to a method for measuring by glow discharge spectrometry the elementary and/or molecular chemical composition of a solid sample comprising at least one polymer or organic layer.

According to the invention, the method comprises the following steps:

- arranging the sample so as to close a vacuum chamber of a plasma reactor, the plasma reactor forming a source of ions for a mass spectrometer, the sample forming one of the electrodes of the glow discharge plasma reactor;
- injecting in the vacuum chamber a gaseous mixture comprising at least one rare gas and gaseous oxygen, the concentration in gaseous oxygen being comprised between 0.1 and 15 mass % of the gaseous mixture, it is applied, to the electrodes of the reactor, an electric discharge adapted to generate a glow discharge plasma so as to expose the solid sample to said plasma;
- selecting and measuring, by means of the mass spectrometer, at least one signal representative of an ionized species of negative charge.

The method allows etching a sample, for example a polymer or organic sample, with a significant etching rate, typically comprised between 100 nanometers/minute and 1 micron/minute, with a flat-bottom etching crater. This method allows, on the one hand, detecting and measuring ionized species different from the usually measured ionized species of positive charge or excited species measured by optical emission spectrometry. On the other hand, the method allows measuring signals having an intensity and/or a signal-to-noise ratio far higher than the signals representative of ionized species of positive charge or than the optical emission signals, in the same plasma conditions and for a same sample.

According to a preferred embodiment of the invention, the rare gas of the gaseous mixture is chosen among argon, neon, krypton, helium or a mixture of said rare gases.

In a particular embodiment, the solid sample includes a stack of organic or polymer layers.

According to another particular aspect, the mass spectrometer being of the time-of-flight spectrometer type, at least one signal representative of an ionized species of negative charge is measured as a function of the respective time of flight of said ionized species.

According to particular and advantageous embodiment of the method, the sample to be measured comprises a stack of layers and the concentration in oxygen of the gaseous mixture during the exposure to the glow discharge plasma is modified as a function of the layer of the stack that is exposed to said plasma.

According to a particular aspect, a radiofrequency or pulsed radiofrequency electric discharge is applied.

According to another particular aspect, said method comprises the simultaneous application of a radiofrequency or pulsed radiofrequency electric field and a magnetic field that is axial or transverse with respect to an axis of the glow discharge plasma reactor.

According to a preferred embodiment of the invention, said method further comprises a calibration step in which:

- a reference sample having a known composition is placed in the vacuum chamber of the glow discharge plasma reactor, the reference sample forming one of the electrodes of the plasma reactor;
- a gaseous mixture comprising at least one rare gas and gaseous oxygen is injected into the vacuum chamber, the concentration in gaseous oxygen being comprised between 0.1 and 15 mass % of the gaseous mixture, an electric discharge adapted to generate a glow discharge plasma is applied to the electrodes of the plasma reactor, so as to expose said reference sample to said plasma;
- at least one signal representative of an ionized species of negative charge of said plasma is measured by mass spectrometry;
- the measurement by mass spectrometry of said ionized species of negative charge is calibrated relative to the known composition of said reference sample.

According to a particular embodiment, the method comprises another step in which at least one other signal representative of another ionized species of positive charge is selected and measured by means of another mass spectrometer.

The invention also relates to a glow discharge spectrometry device for the analysis of a solid sample, preferably comprising at least one organic or polymer layer, said spectrometry device including a glow discharge plasma reactor including a vacuum chamber connected to a plasma gas injection fluid circuit, the glow discharge plasma reactor including an electric circuit adapted to apply a preferably radiofrequency or pulsed radiofrequency, electric discharge between the solid sample to be analysed and an electrode in the presence of said plasma gas so as to generate a glow discharge plasma, a mass spectrometer connected to the vacuum chamber of the glow discharge plasma reactor so as to extract ionized species from said glow discharge plasma, the mass spectrometer including a mass analyser adapted to analyse said ionized species and a detector adapted to detect said analysed ionized species.

According to the invention, the gas injection fluid circuit is adapted to inject into the vacuum chamber of the glow discharge plasma reactor a gaseous mixture comprising gaseous oxygen and at least one rare gas, the concentration in gaseous oxygen being comprised between 0.1 and 15 mass % of the gaseous mixture, so as to expose the solid sample to the glow discharge plasma formed by glow discharge of said oxygenated gaseous mixture, and the mass spectrometer is arranged and adapted to detect and measure at least one signal representative of an ionized species of negative charge.

According to a particular and advantageous embodiment of the glow discharge spectrometry device, the electric circuit is adapted to apply a radiofrequency or pulsed radiofrequency electric discharge.

According to a preferred embodiment, the mass spectrometer includes a time-of-flight mass analyser.

According to a particular embodiment, the glow discharge spectrometry device further includes another mass spectrometer connected to the vacuum chamber of the glow discharge plasma reactor so as to extract other ionized species from said glow discharge plasma, wherein said other mass spectrometer is arranged and adapted to detect and measure at least one other signal representative of another ionized species of positive charge.

Hence, the glow discharge spectrometry device allows measuring simultaneously ions of negative charge and other ions of positive charge.

The invention advantageously allows analysing the elementary chemical composition of materials or stacks of thin or thick layers, wherein this analysis can be depth-resolved.

The invention will find a particularly advantageous application in the analysis of the polymer or organic solid materials of low thickness and/or in thin layer and/or in thick layer, able to reach several tens of microns of thickness within a time limited to a few minutes or a few tens of minutes.

The invention allows analysing stacks of different polymer materials and differentiating these materials as a function of the etching depth.

The method and the system of the invention allow analysing interface layers buried under an upper layer of several tens of microns thick.

The present invention also relates to the characteristics that will be revealed in the following description and that will have to be considered in isolation or according to any technically possible combination thereof.

BRIEF DESCRIPTION OF THE DRAWINGS

This description, given only by way of non-limitative example, will allow a better understanding of how the invention may be implemented, with reference to the appended drawings, in which:

FIG. 3 schematically shows a sectional view of a glow discharge plasma reactor coupled to a mass spectrometer;

FIG. 4 schematically shows a glow discharge spectrometry device coupled to a time-of-flight mass spectrometer;

DETAILED DESCRIPTION OF THE PREFERRED EMBODIMENTS

Figure 1:
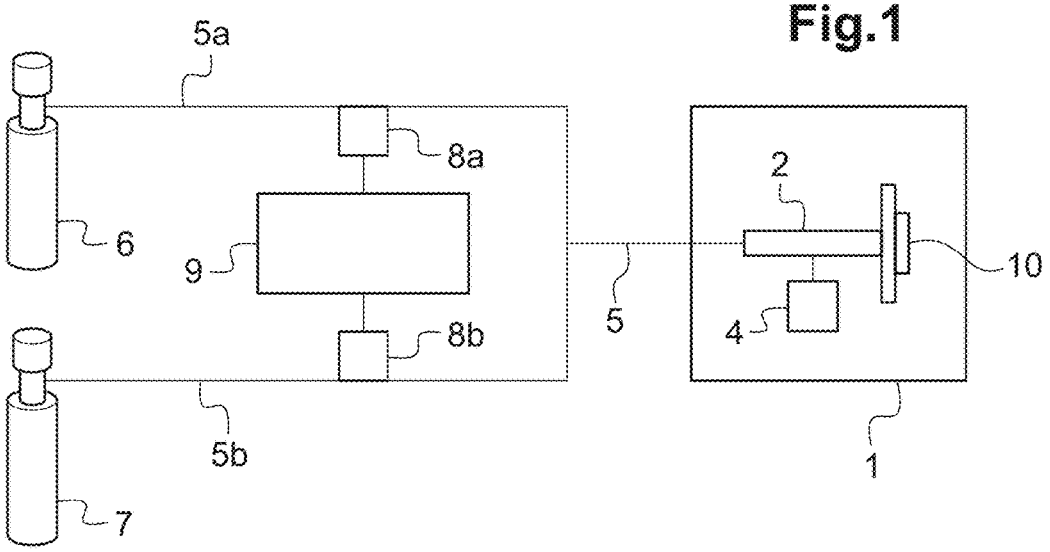
FIG. 1 schematically shows a glow discharge spectrometry device equipped with a gas mixing system.

FIG. 1 schematically shows a glow discharge spectrometry device 1 equipped with a system for supplying a bearing gas for the plasma discharge. The glow discharge spectrometry device 1 comprises a plasma reactor 2, generally of the Grimm lamp type, tubular in shape, inside which is confined the plasma. The gas pumping system is not shown in the scheme of FIG. 1. A solid sample 10 is exposed to the glow discharge plasma. Generally, the sample 10 forms one of the electrodes of the plasma reactor 2. The glow discharge spectrometry device 1 comprises a spectrometer 4, which is herein a mass spectrometer (MS), for the analysis of ionized species of the plasma.

A mass spectrometer measures the elements and compounds as a function of their mass-to-charge ratio m/z. Compared with the optical spectrometry that is simpler, the mass spectrometry generally allows a better sensitivity.

There exist different types of mass spectrometry devices as a function of the type of analyser and detector. The mass spectrometer is for example of the time-of-flight mass spectrometer (TOF-MS) type. Compared with a sequential mass analyser, a time-of-flight mass spectrometer allows recording entirely and almost-continuously a mass spectrum (a complete spectrum every 30 microseconds), which allows a continuous control of all the species as a function of the etching depth in the sample. The measurement dynamics of the detector allows measuring at once the elements and components forming the matrix of the sample, the majority elements, but also elements present as traces. Moreover, the mass spectrometry allows analysing the presence of isotopic markers used for example to highlight the presence and the diffusion of certain species in a material, for example for studying the corrosion.

A bearing gas supply line 5 connects one or several gas sources to the vacuum chamber of the reactor 2. In the example shown in FIG. 1, the gas supply line 5 is divided into two supply lines 5*a* and 5*b* connected to a first gas source 6 and a second gas source 7, respectively. The first gas source 6 is for example a bottle comprising a mixture of argon and oxygen (for example, 4 mass % of gaseous oxygen). The second gas source 7 is a bottle of pure argon. A first flowmeter 8*a* allows adjusting the gas flowrate in the line 5*a* coming from the first gas source 6 and directed towards the gas supply line 5 of the plasma reactor 2. A second flowmeter 8*b* allows adjusting the gas flowrate in the line 5*b* coming from the second gas source 7 and directed towards the gas supply line 5 of the plasma reactor 2. A controller 9 allows adjusting the commands of the flowmeters 8*a* and 8*b* so as to obtain the desired concentration of the gas mixture injected via the line 5 into the vacuum chamber of the plasma reactor.

In particular, for the analysis by glow discharge spectrometry of materials including at least one organic or polymer layer, the addition of gaseous oxygen to the plasma gas has positive effects (see the patent document FR2965355). Indeed, it is observed that the addition of gaseous oxygen to a neutral plasma gas allows producing both a fast erosion of organic or polymer materials and a flat-bottom erosion crater in these materials. The proportion of gaseous oxygen in the gaseous mixture is preferably comprised between 0.1 and 15 mass % of the gaseous mixture. This proportion is sufficient to obtain a high increase of the etching rate of a layer of organic or polymer material.

The etching rate of a polymer or organic sample is generally comprised between about 100 nanometers/minute and 1 micron/minute.

However, argon, or another rare gas, remains the majority gaseous species in this gaseous mixture.

Now, in mass spectrometry of a pure argon plasma, the privileged and most used mode corresponds to the detection and measurement of ionized species of positive charge. Indeed, it is known that argon essentially generates ions of positive charge.

In the presence of a gaseous mixture including a high majority of argon (from 85% to 99.9% in specific volume, preferably between 90% and 99% of the specific volume), it is expected that the gaseous mixture also produces a majority of ions of positive charge.

The publication of S. Canulescu, I. S. Molchan, C. Tauziede, A. Tempez, J. A. Whitby, G. E. Thompson, P. Skeldon, P. Chapon, J. Michler, "Detection of negative ions in glow discharge mass spectrometry for analysis of solid specimens" describes the analysis of a film of tantalum comprising fluorine, exposed to an argon pulsed RF glow discharge plasma, which allows detecting ions of negative charge, in particular of halogenated ionized species. However, the intensity of the signals measured is very low (a few tens of ions/extraction).

The publication of G. Lotito, D. Günther, "Negative ion laser ablation glow discharge-time of flight mass spectrometry of organic molecules", Int. Journ. Of Mass Spectrometry 315 (2012) 60-65, describes the laser ablation of organic molecules transferred into an argon plasma discharge, coupled to a mass spectrometer configured to measure ions of negative charge (LAGD-TOFMS). However, the sensitivity of the measurements by mass spectrometry in negative mode for these organic molecules is extremely low, of several orders of magnitude, by comparison with measurements of the MALDI (Matrix Absorption Laser Assisted Ionization) type.

Figure 2:
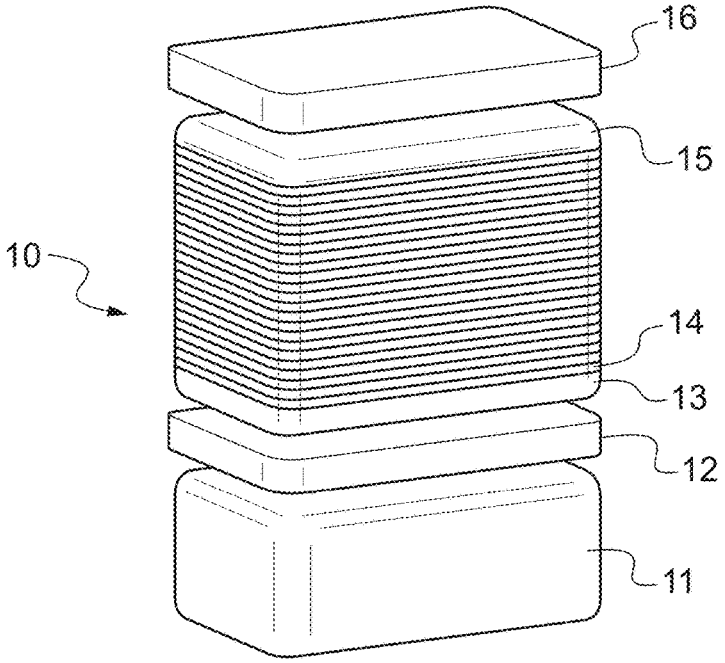
FIG. 2 schematically shows an exploded view of a multilayer sample.

FIG. 2 schematically shows as an exploded view an example of sample 10 that it is desired to be analysed by glow discharge mass spectrometry. The sample 10 comprises a substrate 11, an intermediate layer 12, for example an adhesion layer, a substrate protective layer, or interdiffusion elements between the substrate and the other layers. The sample 10 may have a complex structure, for example a stack of layers 13, 14 . . . 15.

Finally, the sample includes an upper layer 16, that is for example a protective layer, a native oxide layer, an anti-corrosion protective layer or a tribological coating layer. In the contemplated application, the sample 10 includes at least one layer of organic or polymer material.

FIG. 3 schematically shows a sectional view of a glow discharge plasma reactor 2 coupled to a mass spectrometer, according to an embodiment of the invention. The glow discharge plasma reactor includes a vacuum chamber 22. A vacuum pumping system 25 is connected to the vacuum chamber 22. On the other hand, a gas arrival line 5 is connected to the vacuum chamber 22, to allow the admission of the gaseous mixture including a mixture of gaseous oxygen and neutral gas. A tubular electrode 23 is placed inside the plasma reactor. The tubular electrode 23 is for example connected to the mass. The sample 10 to be analysed is placed against another electrode 3 connected to an electric supply source. Particularly advantageously, a pulsed RF electric source is used, which allows minimizing the thermal stresses induced in the sample 10, in particular for the fragile materials. The vacuum chamber 22 of the glow discharge plasma reactor 2 is coupled to a mass spectrometer 4 that detects ionized species extracted from the plasma.

In glow discharge mass spectrometry, the use of a pulsed RF source offers particular advantages due to the fact that the mechanisms of ionization of the species present in the plasma vary over the period of the RF source. An electric power provided by an RF generator is applied to the electrode 3 in order to produce an electric pulse for a limited duration. Measurements by mass spectrometry are performed just before the beginning of the electric pulse, during the electric pulse and after the end of this electric pulse. The mass spectrometry signal may be analysed over different time zones respectively called prepeack, plateau and post-pulse (afterglow). The exploitation of the mass spectrometry signals over these three time zones offers analytical combinations that are original and rich in information not only for the fragile materials but for any type of materials and stacks of thin layers.

In particular, it has been observed that the ionic signals generally appear more intense in the afterglow zone after the quenching of a plasma pulse. The publication of N. Tuccito et al. (Rapid Comm. Mass Spectrom. 2009, 23: 549-556) indicates that the time distribution of the maxima of the mass spectrometry signals is peculiar to each element. This publication also demonstrates that it is not only possible to optimize the measurement of each element with a time-of-flight mass spectrometer but also to analyse ionized molecular fragments, which allows discriminating polymers of similar elementary composition but of different molecular structure. The publication of L. Lobo et al. (A Comparison of non-pulsed radiofrequency and pulsed radiofrequency glow discharge orthogonal time-of-flight mass spectrometry for analytical purposes, J. Anal. At. Spectrom., 2009, 24, 1373-1381) has shown that it is possible to obtain in glow discharge mass spectrometry signal-to-background ratios and hence sensitivities far higher in pulsed mode than those obtained in continuous mode (not pulsed). Moreover, the publication of Lobo et al. highlights that an accurate selection of the time interval of integration in pulsed mode allows optimizing the performances in terms of ionic separation and accuracy and reproducibility of the measurements of isotope ratios.

It appears nowadays absolutely decisive to be able to perform simultaneous or quasi-simultaneous mass spectrometry measurements (as in the time-of-flight devices) in pulsed mode.

Now, in glow discharge mass spectrometry in pulsed RF mode, it is observed that the presence of oxygen in the plasma has a so-called quenching, negative effect on the metastable species, that are the main source of ionization of the positive species in the afterglow domain.

In other words, it seems that the positive ionized species are very rapidly deactivated in the presence of oxygen in the plasma gas. The physicochemical mechanisms that occur in a glow discharge plasma and that underlie this deactivation are very complex.

Nevertheless, the afterglow time domain is just the privileged zone of interest for the analysis of materials, in particular for the polymer or organic materials.

Glow discharge mass spectrometry conventionally measures the ionized species of positive charge. Indeed, the rare gas, for example argon, generates above all ionized species of positive charge. In the case of the mass spectrometry analysis, the use of a mixture of rare gas and oxygen, with a proportion of oxygen comprised between 1 and 10 mass %, allows increasing the etching rate in samples comprising at least one polymer or organic layer. However, this method does not allow increasing the ionization yields of the ionized species of positive charge and hence does not allow improving the signal-to-noise ratio of the signals detected by mass spectrometry.

The measurement of the negative species in glow discharge mass spectrometry has been studied in particular by S. Canulescu (Anal. Bioanal. Chem. (2010) 396:2871-2879) for halogenated materials exposed to an argon plasma.

G. Lotito and D. Günther, International Journal of Mass Spectrometry 315 (2012) 60-65 describe the analysis by glow discharge spectrometry of ionised species of negative charge coming from an argon plasma in pulsed RF mode in which organic molecules obtained by laser ablation are injected. However, the authors conclude that the sensitivity of this technique is lower by several orders of magnitude than the sensitivity obtained by the MALDI (Matrix Assisted Laser Desorption Ionization) technique. An aspect of the present invention is based on the selection of the ions of negative charge and on the detection of a mass spectrometry signal of these negative ions in combination with the exposure to a plasma in the presence of a gaseous mixture of oxygen and rare gas. For that purpose, the mass spectrometer 4 is configured in negative mode, so as to extract only ions of negative charge from the glow discharge plasma formed in the presence of a mixture of rare gas and oxygen.

Now, the ionization mechanisms depend on the chemical species and on the electric charge of the ionized species. It is surprisingly observed that, contrary to the signals relating to the ionized species of positive charge, the mass spectrometry signals relating to the ionized species of negative charge have a high intensity, including in pulsed mode in the time zone after the pulse end (or afterglow), when the gaseous mixture includes oxygen, in particular during the analysis of samples comprising an organic or polymer layer.

A mass spectrometer allows measuring ionized species, either of negative charge or of positive charge. It is in practice not possible to measure simultaneously these two types of species in a same spectrometer. The electrodes of a mass spectrometer must be progressively connected to an electric potential of several hundreds to a few thousands of volts. The change of polarization of the electrodes of a mass spectrometer must hence be carried out progressively. A too fast inversion of the polarities of a mass spectrometer may in certain cases damage the mass spectrometer. It is hence not possible to rapidly invert the polarity of the electrodes of a mass spectrometer for the detection of the negative ionized species.

According to an aspect of the invention, the mass spectrometer is configured for the detection of negative ionized species before the starting of the glow discharge plasma.

FIG. 4 schematically shows a glow discharge spectrometry device coupled to a time-of-flight mass spectrometer 4 polarized so as to detect and measure the ionized species of negative charge.

The glow discharge spectrometry device includes a glow discharge plasma reactor 2 comprising a vacuum chamber connected to a gas arrival line 5. A bottle 6 comprising a mixture of oxygen and rare gas, for example argon with 4 mass % of oxygen, and another bottle 7 comprising rare gas (argon) are connected to the gas arrival line 5. The sample 10 is placed in the plasma reactor in contact with a counter-electrode 3. A pulsed RF electric supply source 33 is electrically connected to the counter-electrode 3. The mean power applied is generally comprised between a few watts and one hundred of watts, the pressure of the gaseous mixture is of a few torrs.

The time-of-flight mass spectrometer 4 is connected to the vacuum chamber of the plasma reactor so as to extract ionized species of negative charge from the glow discharge plasma and to analyse them on the one hand as a function of their mass-to-charge ratio and on the other hand as a function of time. The time-of-flight mass spectrometer 4 illustrated in FIG. 4 comprises a valve 40, a filter (skimmer) 41, an ionic optical system 42, 43, an orthogonal mass spectrometer (48) with its electronic systems (pulser 44, and ionic mirror 45), and a detector 46 that typically detects a mass spectrum, for example approximately every 30 microseconds.

The time-of-flight mass spectrometer 4 is equipped with a three-stage turbomolecular pump system 50, 51, 52.

The time-of-flight mass spectrometer 4 is configured and adapted to extract only ionized species of negative charge out of the glow discharge plasma formed in the plasma reactor 2, in the presence of a gaseous mixture of oxygen and rare gas.

The time-of-flight mass spectrometer 4 allows analysing the ionized species of negative charge as a function of their mass-to-charge ratio m/z.

Figure 5:
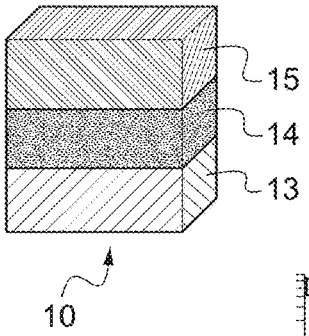
FIG. 5 schematically shows an exploded view of a multilayer sample.

FIG. 5 schematically shows in perspective an example of sample 10 that is analysed by glow discharge mass spectrometry. By way of illustrative and non-limitative example, the sample 10 includes a stack consisted of a substrate 13 of polyethylene, a layer 14 of polyvinylidene chloride of about 2 microns thick, and a layer 15 of nylon of about 10 microns thick.

It is to be noted that the measurement of this sample with a plasma of argon alone is impossible, the etching rate being reduced to a few nm/min.

Figure 7:
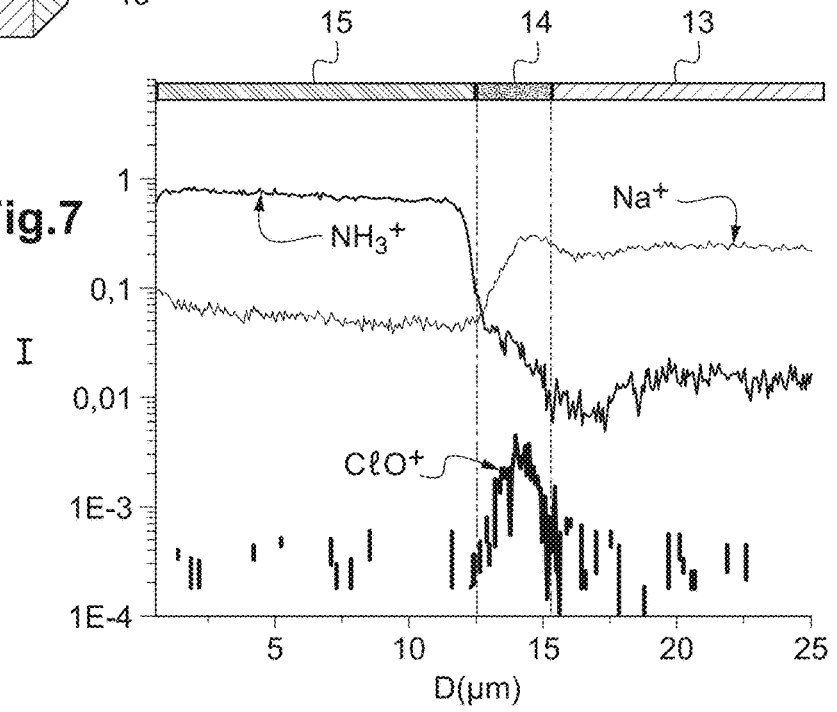
FIG. 7 illustrates an example of measurement by a time-of-flight mass spectrometer of an organic sample similar to that of FIG. 5, the mass spectrometer being configured in positive mode.

FIG. 7 illustrates an example of measurement by a time-of-flight mass spectrometer in pulsed RF mode of an organic sample, the time-of-flight mass spectrometer 4 being configured in positive mode and the plasma being performed in a mixture of oxygen and rare gas, with a proportion of 5% of oxygen in specific volume of the mixture.

More precisely, FIG. 7 shows as a function of the etching depth D in the sample, the intensity I (ionic intensities) of the signals relating to different ionized species respectively associated with different mass-to-charge ratios m/z. Otherwise known methods of analysis allow identifying the ionized species detected as a function of their mass-to-charge ratio. More particularly, in FIG. 7, different signals respectively associated with the presence of the following ionized species: hydrogen nitride ($NH_3^+$), sodium ($Na^+$), and chlorine oxide (ion $ClO^+$), have been identified. The etching depth D in the sample is calibrated by otherwise known methods of calibration. The layers 13, 14, 15 corresponding to the etching depth D in the sample have been shown on an axis parallel to the abscissa axis.

The use of the mixture of oxygen and rare gas allows etching an erosion crater of several tens of microns in the solid sample (see the scale on the abscissa of FIG. 7).

It is observed that the scale of intensity of the signals of time-of-flight mass spectrometry relating to the ionized species of positive charge remains limited to a dynamics of measurement comprised between about $10^{-4}$ and 1. In a more detailed manner, after an etching depth of about twelve microns in the sample (between 10 and 15 microns), it is observed in FIG. 7, a reduction of the signal representative of the hydrogen nitride ion ($NH_3^+$) and an increase of the signal relating to the sodium ion ($Na^+$). After an etching depth of about 15 microns in the sample, the signals representative of the hydrogen nitride ion ($NH_3^+$) and of the sodium ion ($Na^+$) each reach a plateau. It is noted that the signals of mass spectrometry relating to the chlorinated ionized species (ion $ClO^+$) are very low, and almost undetectable because of the same order of magnitude as the noise of the signal.

Figure 6:
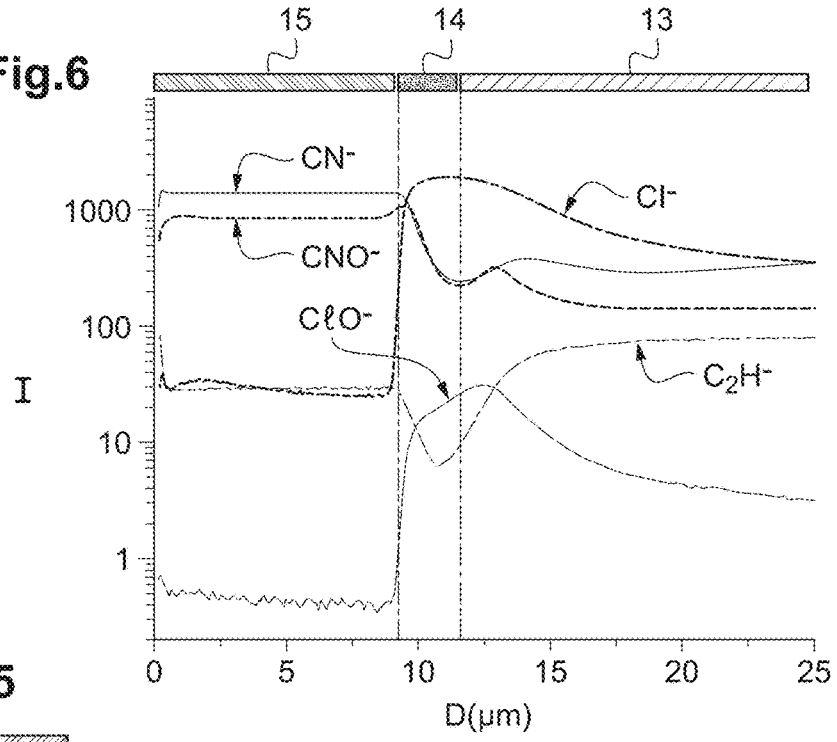
FIG. 6 illustrates an example of measurement by a time-of-flight mass spectrometer of an organic sample, the mass spectrometer being configured in negative mode.

FIG. 6 illustrates an example of measurement by a time-of-flight mass spectrometer of an organic sample similar to that of FIG. 5, the mass spectrometer being configured in negative mode, still in the presence of a gaseous mixture of oxygen and rare gas.

In FIG. 6, it is observed that the scale of intensity of the signals of time-of-flight mass spectrometry relating to the ionized species of negative charge extends from about $10^0$ to about $10^5$. Moreover, in negative mode, the time-of-flight mass spectrometer allows detecting ionized species in abundance such as $ClO^-$, $Cl^-$, $CN^-$, $ONO^-$ and $C_2H^-$. Combined to a gaseous mixture of oxygen and rare gas, the mass spectrometry configured to detect ionized species of negative charge hence allows detecting ionized species such as chlorine, that do not appear, or in tiny quantity, in the mass spectrum of the ionized species of positive charge. Moreover, the intensity of the signals measured in negative mode is far higher than that of the signals measured in positive mode. The changes of layers are clearly observed. Hence, for an etching depth D comprised between 0 and about 8 microns, the nylon layer 15 has essentially signals representative of the nitride ions $CN^-$ and $CNO^-$ that are non-halogenated ionized species. During the etching of the layer 14 of polyvinylidene chloride, for an etching depth D comprised between 8 and 12 microns, a strong increase of the signals representative of the chlorinated ions $ClO^-$ and $Cl^-$ or is observed. Finally, during the etching of the layer 13 of polyethylene, for an etching depth D comprised between about 12 and 25 microns, it is observed an increase of the signal representative of the ion $C_2H^-$ and a relative reduction of the signals representative of the chlorinated ions $ClO^-$ a and $Cl^-$ and of the nitride ions $CN^-$ and $CNO^-$. The signal-to-noise ratio of the measurements by glow discharge mass spectrometry is considerably increased in negative mode by comparison with the positive mode. This increase of intensity of the signals measured by mass spectrometry is particularly interesting in the application to a sample comprising at least one layer of organic or polymer material.

The mechanisms linked to the formation of ionized species of negative, and respectively positive, charge are very different. However, the mechanisms of formation of the ionized species in a glow discharge plasma are very complex and hardly foreseeable as a function of the physicochemical nature of the sample, of the plasma gas and according to the conditions of the electric discharge.

The mass spectrometry measurement of ionized species of negative charge allows analysing ionized species different from the ionized species of positive charge, obtained in the same conditions of plasma and with a same sample.

It seems that the presence of oxygen in the plasma gas allows increasing the production of ionized species of negative charge in the glow discharge plasma and hence highly increasing the intensity of the signals of mass spectrometry measurement of ionized species of negative charge. Mass spectrometry measurements of ionized species of negative charge are hence detected, which have far better a signal-to-noise ratio than in positive mode.

Combined with the use of a mixture of gas comprising gaseous oxygen and a neutral gas, the mass spectrometry in negative mode allows combining the advantages of high etching rate, of etching with an erosion crater having a flat bottom and able to be deep (several tens of microns) and the obtaining of mass spectrometry measurements that have a high intensity, and a high signal-to-noise ratio, in particular in the afterglow region of a glow discharge of pulsed RF mode.

These mass spectrometry measurements in negative mode, in the presence of a glow discharge in a mixture of rare gas and oxygen, provide signals having an intensity that is higher than the intensity of mass spectrometry signals in positive mode, including and surprisingly for the detection of non-halogenated ionized species, and particularly for the detection on non-halogenated ionized species, such as metal species or organic species (i.e. essentially composed of the carbon, hydrogen, oxygen and/or nitrogen elements).

The device and the method of the invention apply in particular to the analysis of a stack of different polymer layers.

The device and the method of the invention also apply to the analysis of hybrid samples comprising a polymer layer deposited on a metal substrate, or a polymer layer deposited on a glass substrate, or a metal layer deposited on a polymer substrate.

The invention claimed is:

1. A method of measurement by glow discharge spectrometry of the elementary and/or molecular chemical composition of a solid sample including at least one organic or polymer layer, which comprises the following steps:

arranging the sample so as to close a vacuum chamber of a glow discharge plasma reactor, injecting in the vacuum chamber a gaseous mixture comprising at least one rare gas and gaseous oxygen, the concentration in gaseous oxygen being comprised between 0.1 and 15 mass % of the gaseous mixture, an electric discharge adapted to generate a glow discharge plasma is applied to the electrodes of the reactor, so as to expose the solid sample to said plasma;

selecting and measuring, by means of a mass spectrometer, at least one signal representative of a non-halogenated ionized species of negative charge, said non-halogenated ionized species being essentially composed of at least one of the group consisting of carbon and hydrogen elements, wherein said non-halogenated ionized species of negative charge is formed by ionization of species etched from a surface of the at least one organic or polymer layer of the solid sample in said glow discharge plasma.

2. The method of measurement by glow discharge spectrometry according to claim 1, wherein the at least one rare gas is chosen among argon, neon, krypton, helium or a mixture of said rare gases.

3. The method of measurement by glow discharge spectrometry according to claim 1, wherein the solid sample includes a stack of organic or polymer layers.

4. The method of measurement by glow discharge spectrometry according to claim 3, wherein the mass spectrometer being of the time-of-flight spectrometer type, at least one signal representative of an ionized species of negative charge is measured as a function of the respective time of flight of said ionized species.

5. The method of measurement by glow discharge spectrometry according to claim 3, wherein the solid sample to be measured includes a stack of layers, and wherein the concentration in oxygen of the gaseous mixture during the exposure to the glow discharge plasma is modified as a function of the layer of the stack that is exposed to said plasma.

6. The method of measurement by glow discharge spectrometry according to claim 3, wherein said method comprises another step in which at least one other signal representative of another ionized species of positive charge is selected and measured by means of another mass spectrometer.

7. The method of measurement by glow discharge spectrometry according to claim 1, wherein the mass spectrometer being of the time-of-flight spectrometer type, at least one signal representative of an ionized species of negative charge is measured as a function of the respective time of flight of said ionized species.

8. The method of measurement by glow discharge spectrometry according to claim 7, wherein the solid sample to be measured includes a stack of layers, and wherein the concentration in oxygen of the gaseous mixture during the exposure to the glow discharge plasma is modified as a function of the layer of the stack that is exposed to said plasma.

9. The method of measurement by glow discharge spectrometry according to claim 7, wherein said method comprises the simultaneous application of a radiofrequency or pulsed radiofrequency electric field and a magnetic field that is axial or transverse with respect to an axis of the glow discharge plasma reactor.

10. The method of measurement by glow discharge spectrometry according to claim 1, wherein the solid sample to be measured includes a stack of layers, and wherein the concentration in oxygen of the gaseous mixture during the exposure to the glow discharge plasma is modified as a function of the layer of the stack that is exposed to said plasma.

11. The method of measurement by glow discharge spectrometry according to claim 10, wherein said method comprises another step in which at least one other signal representative of another ionized species of positive charge is selected and measured by means of another mass spectrometer.

12. The method of measurement by glow discharge spectrometry according to claim 1, wherein said method comprises the simultaneous application of a radiofrequency or pulsed radiofrequency electric field and a magnetic field that is axial or transverse with respect to an axis of the glow discharge plasma reactor.

13. The method of measurement by glow discharge spectrometry according to claim 12, wherein said method comprises another step in which at least one other signal representative of another ionized species of positive charge is selected and measured by means of another mass spectrometer.

14. The method of measurement by glow discharge spectrometry according to claim 1, wherein said method further comprises a calibration step in which:

a reference sample having a known composition is placed in the vacuum chamber of the glow discharge plasma reactor, the reference sample forming one of the electrodes of the plasma reactor;

a gaseous mixture comprising at least one rare gas and gaseous oxygen is injected into the vacuum chamber, the concentration in gaseous oxygen being comprised between 0.1 and 15 mass % of the gaseous mixture, an electric discharge adapted to generate a glow discharge plasma is applied to the electrodes of the plasma reactor, so as to expose said reference sample to said plasma;

at least one signal representative of an ionized species of negative charge of said plasma is measured by mass spectrometry;

the measurement by mass spectrometry of said ionized species of negative charge is calibrated relative to the known composition of said reference sample.

15. The method of measurement by glow discharge spectrometry according to claim 1, wherein said method comprises another step in which at least one other signal representative of another ionized species of positive charge is selected and measured by means of another mass spectrometer.

16. A glow discharge spectrometry device for the analysis of a solid sample, comprising at least one organic or polymer layer, said spectrometry device including:

a glow discharge plasma reactor including a vacuum chamber connected to a plasma gas injection fluid circuit (5, 6, 7), the glow discharge plasma reactor including an electric circuit adapted to apply an electric discharge between the solid sample to be analysed and an electrode in the presence of said plasma gas so as to generate a glow discharge plasma, a mass spectrometer connected to the vacuum chamber of the glow discharge plasma reactor so as to extract ionized species from said glow discharge plasma, the mass spectrometer including a mass analyser adapted to analyse said ionized species and a detector (46) adapted to detect said analysed ionized species, wherein:

the gas injection fluid circuit is adapted to inject into the vacuum chamber of the glow discharge plasma reactor a gaseous mixture comprising gaseous oxygen and at least one rare gas, the concentration in gaseous oxygen being comprised between 0.1 and 15 mass % of the gaseous mixture, so as to expose the solid sample to the glow discharge plasma formed by glow discharge of said oxygenated gaseous mixture, and the mass spectrometer is arranged and adapted to detect and measure at least one signal representative of a non-halogenated ionized species of negative charge, said non-halogenated ionized species being essentially composed of at least one of the group consisting of carbon and hydrogen elements, wherein said non-halogenated ionized species of negative charge are formed by ionization of species etched from a surface of the at least one organic or polymer layer of the solid sample in said glow discharge plasma.

17. The glow discharge spectrometry device according to claim 16, wherein the electric circuit is adapted to apply a radiofrequency or pulsed radiofrequency electric discharge.

18. The glow discharge spectrometry device according to claim 16, wherein the mass spectrometer includes a time-of-flight mass analyzer.

19. The glow discharge spectrometry device according to claim 18, further including another mass spectrometer connected to the vacuum chamber of the glow discharge plasma reactor so as to extract other ionized species from said glow discharge plasma, wherein said other mass spectrometer is arranged and adapted to detect and measure at least one other signal representative of another ionized species of positive charge.

20. The glow discharge spectrometry device according to claim 16, further including another mass spectrometer connected to the vacuum chamber of the glow discharge plasma reactor so as to extract other ionized species from said glow discharge plasma, wherein said other mass spectrometer is arranged and adapted to detect and measure at least one other signal representative of another ionized species of positive charge.

* * * * *